United States Patent [19]

v. d. Marwitz

[11] 4,070,712

[45] Jan. 31, 1978

[54] CLEAR WINDOW FOR PROTECTIVE HELMETS

[75] Inventor: Hans-Günther v. d. Marwitz, Munich, Germany

[73] Assignee: Bayerische Motoren Werke Aktiengesellschaft, Germany

[21] Appl. No.: 723,969

[22] Filed: Sept. 16, 1976

[30] Foreign Application Priority Data

Sept. 17, 1975 Germany ..... 2541468

[51] Int. Cl.[2] ..... A61F 9/04; A42B 3/00

[52] U.S. Cl. ..... 2/10; 2/424

[58] Field of Search ..... 2/10, 424, 6, 9, 428, 2/429, 430

[56] References Cited

U.S. PATENT DOCUMENTS

| | | | |
|---|---|---|---|
| 2,615,163 | 10/1952 | Ring | 2/431 |
| 2,903,700 | 9/1959 | Finken et al. | 2/10 |
| 2,956,474 | 10/1960 | Holzwarth et al. | 2/428 X |
| 3,438,060 | 4/1969 | Lobelle | 2/6 |
| 3,727,235 | 4/1973 | Fisher | 2/10 |
| 3,825,952 | 7/1974 | Pershing et al. | 2/422 |
| 3,934,271 | 1/1976 | Rhee | 2/424 |

FOREIGN PATENT DOCUMENTS

| | | | |
|---|---|---|---|
| 7,513,464 | 4/1975 | Germany | 2/424 |

*Primary Examiner*—Werner H. Schroeder
*Assistant Examiner*—Peter Nerbun
*Attorney, Agent, or Firm*—Craig & Antonelli

[57] ABSTRACT

A clear window shield for protective helmets, especially for the users of motor vehicles, whereby the window shield is detachably connected with the protective helmet and is made of laminated glass, which extends over the entire field of vision of the window shield; the window shield abuts indirectly or directly at the edge area of the window aperture of the protective helmet.

31 Claims, 7 Drawing Figures

Fig.4 Fig.5 Fig. 6 Fig. 7
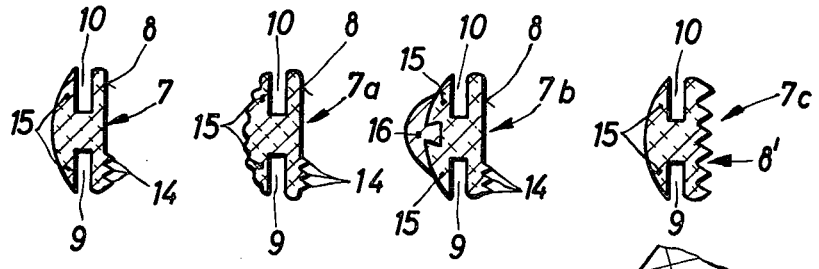
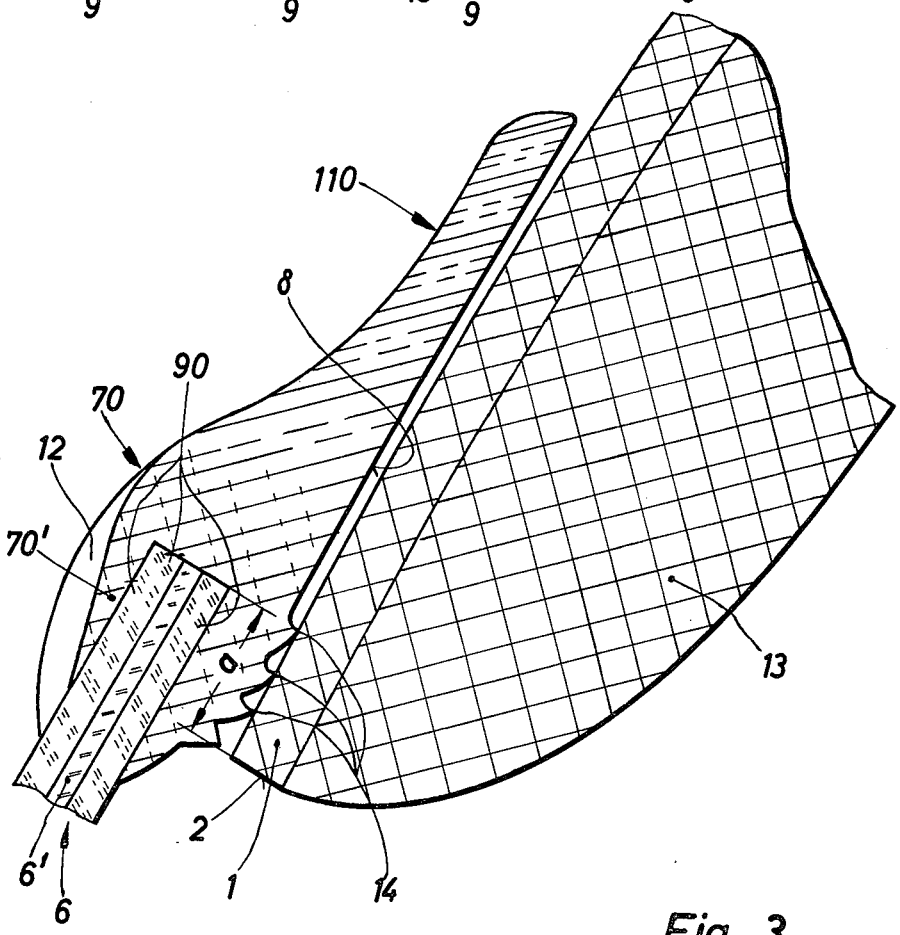
Fig. 3

CLEAR WINDOW FOR PROTECTIVE HELMETS

The present invention relates to a window shield for protective helmets, especially for the users of motor vehicles, whereby the transparent pane of the window shield is detachably connected with the protective helmet.

Window shields of transparent plastic material are known in the art which are buttoned onto the protective helmet within the area of their outer circumference. Such a window shield mounted at the protective helmet of a motorcyclist is very easily scratched when wiping off water and dirt from its outer surface, and therewith becomes nearly opaque, from which may result a traffic-endangering visibility impairment of the motorcyclist in case of rain or when driving at night. At least, the entire window shield has to be exchanged in each case after its surface damage.

For the reason it has already been proposed to provide a window shield consisting of a transparent plastic material with a scratch-resistant laminated glass insert. The window shield is thereby equipped in the central area of its field of vision with a circumferential frame, into which the laminated glass is buttoned-in. The disadvantage with this window shield resides in the fact that the laminated glass may break out of the mounting support in case of a force-influence directed against the windowpane, may fall inwardly and therewith may injure the face of the driver. Additionally, it is disadvantageous that only a relatively small, observation-slot-like field of vision is formed by the inserted laminated glass, as a result of which, on the one hand, an edge area of transparent plastic material remains which as before may become scratched when wiping off dirt, and on the other, the field of vision is disturbingly influenced by the mounting support edge of the laminated glass.

It is therefore the aim of the present invention to so construct a window shield and the arrangement thereof that both a shock-resistant installation is produced as also a clear field of vision remains preserved for the driver also after repeated wiping.

The underlying problems are solved according to the present invention in that the window shield is made of laminated glass, which extends over the entire field of vision of the window shield, whereby the latter abuts indirectly or directly at the edge area of the window aperture of the protective helmet.

In one embodiment of the present invention, provision is made that the window shield sealingly abuts together with the inner cheek of the mounting support at the outer surface of the protective helmet under interposition of the elastic mounting support which receives both the window shield as also a frame rigidly or pivotally secured at the protective helmet.

By reason of the fact that the mounting support serves, on the one hand, as mounting means of the window shield and on the other hand, as sealing element thereof with respect to the outer surface of the protective helmet, sealing profiles which where heretofore customary for that purpose and were provided at the protective helmet, can be advantageously dispensed with.

Accordingly, it is an object of the present invention to provide a window shield for protective helmets which avoids by simple means the aforementioned shortcomings and drawbacks encountered in the prior art.

Another object of the present invention resides in a transparent window for a protective helmet which is not readily scratched when wiping water or dirt off the window.

A further object of the present invention resides in a window for protective helmets formed by a transparent window pane which does not endanger the visibility of the motorcyclist.

A still further object of the present invention resides in a window shield for protective helmets which minimizes the danger of injury to the face of the driver, while at the same time preserving a relatively large field of vision.

These and other objects, features and advantages of the present invention will become more apparent from the following description when taken in connection with the accompanying drawing which shows, for purposes of illustration only, several embodiments in accordance with the present invention, and wherein:

FIG. 3 is a cross-sectional view, on an enlarged scale, taken along line III—III of FIG. 2; and FIGS. 4 to 7 are respectively cross-sectional views, on an enlarged scale, through different embodiments of H-shaped cross-sectional profiles of the mounting support illustrated in FIG. 1.

Figure 1:
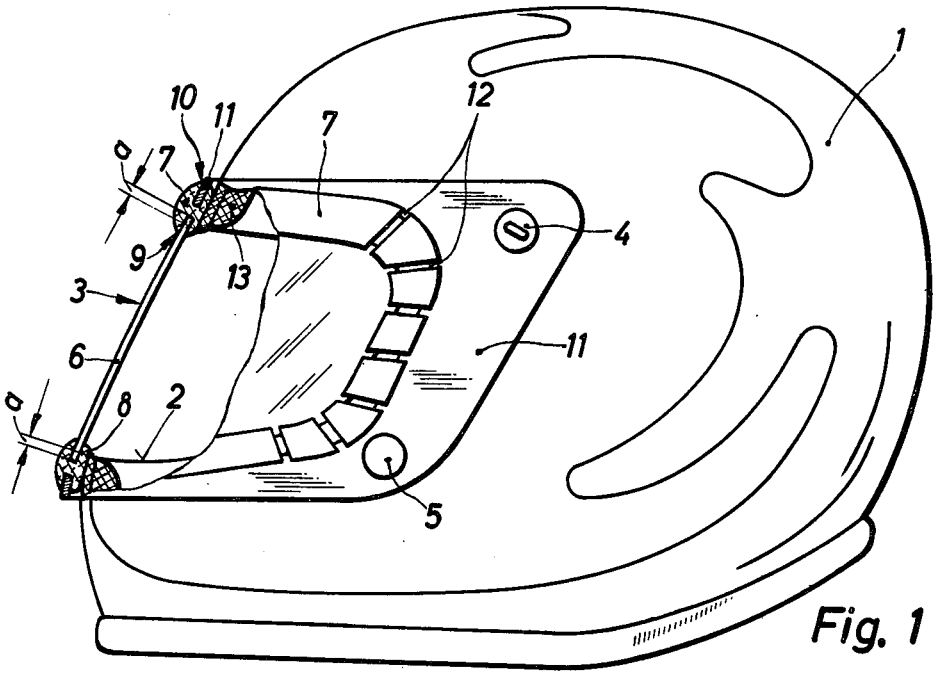
FIG. 1 is a side elevational view of a protective helmet with a clear window shield in accordance with the present invention.

Referring now to the drawing wherein like reference numerals are used throughout the various views to designate like parts, a protective helmet 1 illustrated in FIG. 1 is provided with a window aperture 2 which is covered off by a transparent pane forming a window shield and generally designated by reference numeral 3. The window shield 3 is made of laminated glass 6 which extends over the entire field of vision of the window shield 3. The laminated glass 6 is retained by a mounting support 7 of elastic material and abuts within the area of its edge zone under interposition of the mounting support 7 at the edge area of the window aperture 2 of the protective helmet 1. As a result thereof, an overlap *a* results circumferentially between the outer edge of the laminated glass 6 and the circumferential edge of the window aperture 2 so that the window shield 3 cannot reach the interior space of the protective helmet 1 in case of a force-influence directed against the same from the outside. A lining 13 can be seen within the area of the window aperture 2.

The elastic mounting support 7 which as such is endless, sealingly abuts with its inner cheek or sidewall 8 at the outer surface of the protective helmet 1 and has an H-shaped crosssectional profile, into the inwardly disposed aperture 9 of which is inserted the laminated glass 6, whereas a frame 11 engages into the outwardly pointing aperture 10, which frame 11 in turn is secured at the protective helmet 1 by means of screws 4 or snap buttons 5. The frame 11 consists of metal or synthetic resinous material.

Figure 2:
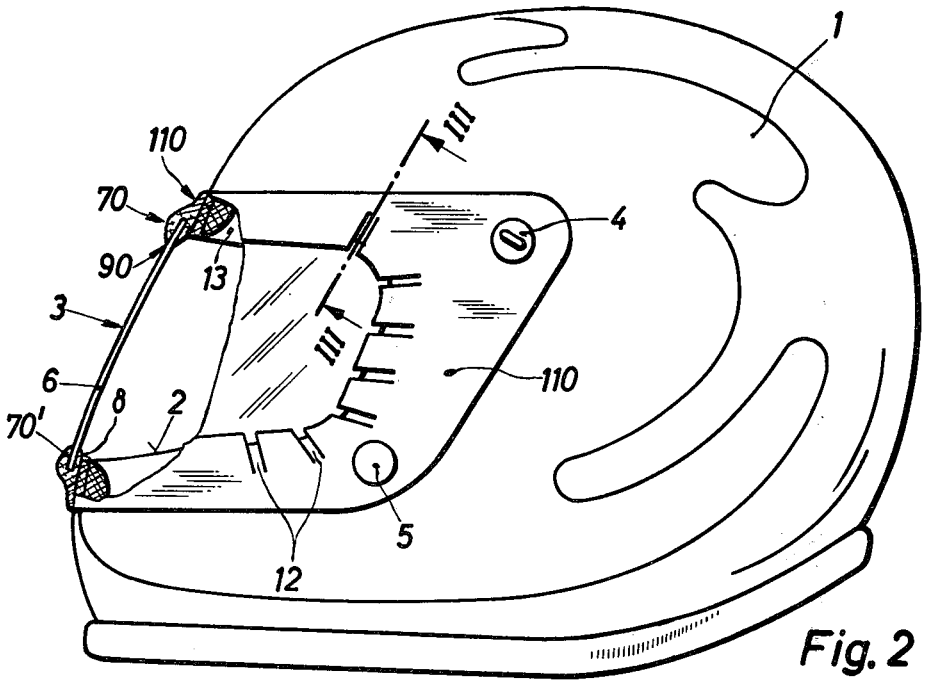
FIG. 2 is a side view of a modified embodiment of a protective helmet with a clear window shield in accordance with the present invention.

The elastic mounting support generally designated by reference numeral 70 of the window shield 3 illustrated in FIG. 2, includes only an inwardly disposed aperture 90, into which is inserted the laminated glass 6. The elastic mounting support 70 passes over in one piece into the frame generally designated by reference numeral 110. The elastic mounting support 70 and the frame 110 are made as a one-piece synthetic resinous part either by injection molding or suitable casting process, whereby the frame 110 is made appropriately of a harder synthetic plastic material as compared to the mounting support 70.

The elastic mounting supports 7 and 70 are provided at their outer sides and in the two lateral areas of the window shield 3 with a number of water-drainage-grooves 12 which extend toward the outside pointing away from the window shield 3. These water-drainage-grooves 12 conduct away the water which collects on the window 3, laterally toward the outside, especially at higher velocities of the motorcycle.

As shown in FIG. 3, the elastic mounting support 70 includes within the area of its inner cheek 8 several outwardly projecting sealing lips 14 which, after fastening of the frame 110 or 11 at the protective helmet 1, abut under prestress at the outer surface thereof and therewith prevent that the water which drains off from the upper and lateral area of the protective helmet 1, is able to enter into the window aperture 2. In a similar manner, the elastic mounting support 7 is provided with sealing lips 14.

The sealing leg 70' of the elastic mounting support 70, which abuts externally at the window shield 3, includes circumferentially a wedge-shaped cross-sectional profile. It is achieved thereby that within the area of the elastic mounting support 70, on the one hand, the water can drain off readily and, on the other, the surface of the window shield 3 can be easily cleaned.

The laminated glass 6 can be equipped with a colored intermediate film 6', by means of which a sun protection advantageously is attainable.

FIGS. 4 to 7 illustrate respectively different constructions of the H-shaped cross-sectional profile of the elastic mounting support 7 illustrated in FIG. 1, whereby the two outwardly disposed sealing legs 15 of the elastic mounting support 7, *7a*, *7b* and *7c* have respectively a wedge-shaped cross-sectional profile in their end areas.

It is shown in FIG. 4 that the H-shaped cross-sectional profile of the elastic mounting support 7 is constructed convexly within the area of the outwardly disposed sealing legs 15.

As shown in FIG. 5, the H-shaped cross-sectional profile *7a* is constructed convexly or also ridged within the area of the outwardly disposed sealing legs 15 whereby the outer wall extends undulated merely for purposes of decoration.

The H-shaped cross-sectional profile of the elastic mounting support *7b* illustrated in FIG. 6 is provided within the area of the outwardly disposed sealing legs 15 with a filler strip 16 which spreads the sealing legs 15 apart in order to attain therewith the safe sealing abutment thereof at the surface of the laminated glass 6. The filler strip 16 may also be provided for purposes of decoration.

FIG. 7 illustrates that the H-shaped cross-sectional profile of the elastic mounting support *7c* is provided with an undulated inner cheek 8', by means of which a very high sealing effect at the outer surface of the protective helmet 1 can be achieved.

The elastic mounting support *7a* and *7b* is each provided with sealing lips 14 whereas all of the elastic mounting supports *7a*, *7b*, and *7c* are provided with water-drainage-grooves 12.

While I have shown and described several embodiments in accordance with the present invention, it is understood that the same is not limited thereto but is susceptible of numerous changes and modifications as known to those skilled in the art, and I therefore do not wish to be limited to the details shown and described herein but intend to cover all such changes and modifications as are encompassed by the scope of the appended claims.

I claim:

1. A window shield for protective helmets, especially for the users of motor vehicles, which includes a window aperture provided in the helmet and window means made of laminated glass which extends substantially over the entire field of vision of the window shield, characterized in that the window means is mounted within an elastic mounting support means which abuts at the edge area of the window aperture provided in the protective helmet so that the window means overlaps the edge area of the window aperture, and frame means joined to said support and detachably connecting said window means to said helmet.

2. A window according to claim 1, characterized in that the frame is rigidly secured at the protective helmet.

3. A window according to claim 1, characterized in that the frame is pivotally secured at the protective helmet.

4. A window according to claim 1, characterized in that said elastic mounting support means includes an inner cheek, and the window means sealingly abuts together with the inner cheek of the elastic mounting support means at the outside of the protective helmet.

5. A window according to claim 4, characterized in that said elastic mounting support means is endless and has an essentially H-shaped cross-sectional profile forming sealing legs and an outwardly pointing aperture, said frame means engaging in said outwardly pointing aperture of the H-shaped cross-sectional profile.

6. A window according to claim 5, characterized in that the frame means is made of a material selected from the group consisting of metal and synthetic plastic material which is more rigid than the material forming said mounting support means.

7. A window according to claim 1, characterized in that the elastic mounting support means is provided with an inwardly disposed aperture receiving the laminated glass.

8. A window according to claim 7, characterized in that the elastic mounting support means and the frame connected therewith are made as a one-piece synthetic resinous part.

9. A window according to claim 8, characterized in that the frame is made of slightly harder synthetic resinous material than the mounting support means.

10. A window according to claim 4, characterized in that the elastic mounting support means is provided within the area of its inner cheek with several sealing lips for abutment at the outer surface of the protective helmet.

11. A window according to claim 10, characterized in that the elastic mounting means is provided at its exterior surface outside of at least the two lateral areas of the window means with a number of water drainage grooves which extend pointing away from the window means in the outward direction.

12. A window according to claim 11, characterized in that at least the sealing lips of the elastic support means which abut externally at the window means have a wedge-shaped cross-sectional profile.

13. A window shield according to claim 5, characterized in that the two outwardly disposed sealing legs of the elastic mounting support means with H-shaped cross-sectional profile are provided each with a wedge-shaped cross-sectional profile in their end areas.

14. A window shield according to claim 5, characterized in that the H-shaped cross-sectional profile of the elastic mounting support means is convexly constructed within the area of the outwardly disposed sealing legs.

15. A window shield according to claim 5, characterized in that the H-shaped cross-sectional profile of the elastic mounting support means is convexly constructed within the area of the outwardly disposed sealing legs and has an undulated outer wall.

16. A window shield according to claim 5, characterized in that the H-shaped cross-sectional profile of the elastic mounting support means is constructed ridged within the area of the outwardly disposed sealing legs and has an undulated outer wall.

17. A window shield according to claim 5, characterized in that a filler strip means is inserted into the H-shaped cross-sectional profile of the elastic mounting support means within the area of the outwardly disposed sealing legs.

18. A window shield according to claim 5, characterized in that the H-shaped cross-sectional profile of the elastic mounting support means has an undulated inner cheek.

19. A window shield according to claim 1, characterized in that the laminated glass is provided with a colored intermediate film.

20. A window shield according to claim 1, characterized in that the laminated glass is provided with a transparent intermediate film.

21. A window according to claim 20, characterized in that the endless elastic mounting support means has an essentially H-shaped cross-sectional profile provided with two outwardly disposed sealing legs and an outwardly pointing aperture, the frame engaging in said outwardly pointing aperture of the H-shaped cross-sectional profile.

22. A window shield according to claim 21, characterized in that the two outwardly disposed sealing legs of the elastic mounting support means with H-shaped cross-sectional profile are provided each with a wedge-shaped cross-sectional profile in their end areas.

23. A window shield according to claim 21, characterized in that the H-shaped cross-sectional profile of the elastic mounting support means is convexly constructed within the area of the outwardly disposed sealing legs.

24. A window shield according to claim 21, characterized in that the H-shaped cross-sectional profile of the elastic mounting support means is convexly constructed within the area of the outwardly disposed sealing legs and has an undulated outer wall.

25. A window shield according to claim 21, characterized in that the H-shaped cross-sectional profile of the elastic mounting support means is constructed ridged within the area of the outwardly disposed sealing legs and has an undulated outer wall.

26. A window shield according to claim 21, characterized in that a filler strip means is inserted into the H-shaped cross-sectional profile of the elastic mounting support means within the area of the outwardly disposed sealing legs.

27. A window according to claim 7, characterized in that at least the sealing leg of the elastic support means which abuts externally at the window means has a wedge-shaped crosssectional profile.

28. A window according to claim 7, characterized in that elastic mounting support means includes an inner cheek, and in that the window means sealingly abuts together with the inner cheek of the elastic mounting support means at the outside of the protective helmet.

29. A window according to claim 28, characterized in that the elastic mounting support means is provided within the area of its inner cheek with several sealing lips for abutment at the outer surface of the protective helmet.

30. A window according to claim 7, characterized in that the elastic mounting support means is provided at its exterior surface outside at least the two lateral areas of the window means with a number of water drainage grooves which extend pointing away from the window means in the outward direction.

31. A window shield for protective helmets, especially for the users of motor vehicles, which includes a window aperture provided in the helmet and window means detachably connected with the protective helmet, characterized in that the window means is made of laminated glass which extends substantially over the entire field of vision of the window shield, the window means abutting at the edge area of the window aperture provided in the protective helmet under interposition of an elastic mounting support means which accommodates the window means and also a frame secured at the protective helmet, said elastic mounting support means including an inner cheek, and the window means sealingly abuting together with the inner cheek of the elastic mounting support means at the outside of the protective helmet, said elastic mounting support means being provided within the area of its inner cheek with several sealing lips for abutment at the outer surface of the protective helmet and being provided at its exterior surface located outside of at least the two lateral areas of the window means with a number of water drainage grooves which extend pointing away from the window means in the outward direction.

* * * * *